US005452925A

United States Patent [19]

Huang

[11] Patent Number: 5,452,925

[45] Date of Patent: Sep. 26, 1995

[54] TIGHTENING LATCHING DEVICE

[76] Inventor: Chien F. Huang, No. 139, Pao Jen 3 Street, Chia I City, Taiwan

[21] Appl. No.: 269,791

[22] Filed: Jun. 30, 1994

[51] Int. Cl.[6] ..... E05C 5/02

[52] U.S. Cl. ..... 292/57; 292/65; 292/98

[58] Field of Search ..... 292/65, 67, 98, 292/102, 109, DIG. 20, DIG. 47

[56] References Cited

U.S. PATENT DOCUMENTS

| | | | |
|---|---|---|---|
| 2,647,287 | 8/1953 | Jones | 292/98 X |
| 2,991,106 | 7/1961 | Claud-Mantle | 292/65 |
| 3,365,223 | 1/1968 | Bisbing | 292/65 X |
| 3,712,653 | 1/1973 | Lehmann | 292/65 X |
| 4,507,010 | 3/1985 | Fujiya | 292/98 X |
| 4,607,510 | 8/1986 | Shanaan et al. | 292/98 X |
| 4,961,602 | 10/1990 | Pettersson | 292/98 |

*Primary Examiner*—Peter M. Cuomo
*Assistant Examiner*—Monica E. Millner
*Attorney, Agent, or Firm*—Peterson, Wicks, Nemer & Kamrath

[57] ABSTRACT

A tightening latching device includes a housing having a pair of curved slots. A roller is rotatably engaged in the housing and includes an actuating piece. A latch is engaged on the roller and has an opening for engaging with the actuating piece. The latch includes two rods for slidably engaging with the curved slots of the housing and movable from one end to the other end of the curved slots. The latch is rotated by the actuating piece and the rods of the latch are moved from one end to the other end of the curved slots so as to engage the latch with an object.

1 Claim, 5 Drawing Sheets

TIGHTENING LATCHING DEVICE

DESCRIPTION OF THE INVENTION

The present invention concerns a tightening latching device, and, more particularly, an improvement in the configuration of tightening latching devices, wherein the tightening latching device of the present invention is made of a plastic material with a high tensile strength and fabricated in a simple precise manner, with which two insulation scarf panels can be quickly and securely latched together as well as disassembled readily.

Scarf panels made of a hard insulating foam material are being employed in areas, such as fabricating refrigerating units and insulating houses. As shown in FIG. 5, the scarf panels 1 are joined together by means of tongue and groove joints, involving the insertion of the tongue 11 into the groove 12. In addition, the two scarf panels 1 are latched tightly together by means of a tightening latching device 2 embedded in the scarf panels 1. Conventional tightening latching devices are typical made of a metal material, with the configuration thereof being shown in FIG. 6. Specifically, said conventional tightening latching device comprises a latching assembly 21 embedded in one insulating scarf panel 1 and a spline assembly 22 embedded in another insulating scarf panel 1, with said latching assembly 21 and spline assembly 22 being in correspondence with each other. Said latching assembly 21 comprises a pair of corresponding plate housings 211 and 212 joined together by welding or scarfjoints. The interior of said latching assembly 21 is equipped with a tightening protruding roller 213, consisting of round plates 2131 and 2132 joined together by welding. A latch 214 is inserted into said tightening protruding roller 213. Additionally, the eccentric shaft of said tightening protruding roller 213 is equipped with a turning hole 2133, allowing said tightening protruding roller 213 to be turned with a wrench. The latch 214 is equipped with two protruding pieces 2141 and 2142 for limiting the movement of said tightening protruding roller 213 by blocking the protruding knob 2134. The stop 213 welded onto the plate housing 211 is employed to limit the movement of said latch 214. Said spline assembly 22 also comprises a pair of corresponding plate housings 221 and 222 joined together by welding and equipped with a stop 223 for accepting the latch 214. As shown in FIG. 7, when said tightening protruding roller 213 is turned via said turning hole 2133 using a wrench, said latch 214 is caused to grip onto said stop 223 of said spline assembly 22. Meanwhile, said eccentric tightening protruding roller 213 forces the latch 214 to retract, thereby allowing said two insulating scarf panels 1 to be latched together tightly. Accordingly, scarf panels can be joined together quickly by the aforementioned technique.

However, it was found that the aforementioned tightening latching devices are subject to the following drawbacks:

1. Said tightening latching device is composed of a latching assembly and spline assembly, both made of a metal material, which is undesirable in that the device can be rested and the configuration is quite complicated, consisting many components. Specifically, conventional devices contain numerous components of various shapes that are difficult to fabricate. In addition, the limiting action pertaining to conventional devices requires the employment of protruding pieces, components of specific shapes and other protruding units, with the assembly of all these components having to be done by welding or scarf joints, which is undesirable in terms of labor cost and production cost.

2. In said conventional metal tightening latching devices, the interior of the latching assembly is equipped with a tightening protruding roller, consisting of two round plates joined together by welding, with a latch being inserted into said tightening protruding roller and said latch being equipped with two protruding pieces for limiting the movement of said tightening protruding roller. Accordingly, said latch and tightening protruding roller comprising two round plates are joined together tightly in order for said two protruding pieces to be able to govern the protruding knob of said tightening protruding roller. As a result of this configuration limitation, it is not uncommon to find that the latch is gripped between the two round plates of said tightening protruding roller as said tightening protruding roller is being turned with a wrench. As a result, a great deal of efforts is needed to accomplish said task. It is also not uncommon to find that the tightening protruding roller and latch in poorly-constructed latching assemblies are bound together as though they are a single unit. As a result, the latch cannot be turned, and the scarf panel equipped with said defective latching assembly has to be discarded. The latching action involving the turning of the tightening protruding roller causes the latch to grip onto the stop of said spline assembly. Since the latch is embedded inside the scarf panel, the latching action cannot be observed. In addition, said latch and tightening protruding roller comprising two round plates are joined together tightly as described above. As a result, the following problems can occur:

2.1 The tightening protruding roller is defective, resulting in the protruding knob thereof not being able to be governed by the protruding pieces on said latch. Consequently, the operator cannot determine whether or not the scarf panels have been latched, resulting in the scarf panels not being joined tightly together.

2.2 Deciding on whether or not the latching operation has been completed is subjective, relying on the experience of the operator. During the step of pulling the latch backward for tightening, which requires the exertion of a significant force, inexperience operators may apply too little of a force, resulting in the scarf panels not being latched tightly, or may apply too great of a force, resulting in said tightening protruding roller being damaged. Therefore, the fact that the completion of the latching operation cannot be ascertained is a serious concern.

2.3 Even though it is claimed that scarf panels can be joined tightly together as well as disassembled readily, using the aforementioned conventional tightening latching devices, the fact is that said latching device cannot be re-use more than a few times due to the configuration limitation of the tightening protruding roller and latch. In fact, it is often found that said latching device can only be used once, because the latch and tightening protruding roller are caused to bind together as though they are a single unit, resulting in the scarf panels not being able to be separated. Accordingly, it can be said that conventional metal tightening latching devices are not desirable.

In light of the aforementioned problems, the inventor conducted repeated and painstaking research, aided by many years of experiences in related manufacturing and product improvements, and arrived at the present invention after discovering a tightening latching device with a configuration better than that of conventional latching devices.

The objective of the present invention is to offer a configuration of tightening latching devices, wherein the tightening latching device of the present invention is made of a plastic material with a high tensile strength, with which two insulation scarf panels can be quickly and securely latched together as well as disassembled readily.

A practical example including figures is described below for explaining the technical means and characteristics of the present invention.

DESCRIPTION OF THE FIGURES

As shown in FIG. 1, the tightening latching device pertaining to the present invention comprises a latching assembly 3 and spline assembly 4, both made of a plastic material with a high tensile strength and fabricated in a simple precise manner.

Figure 1:
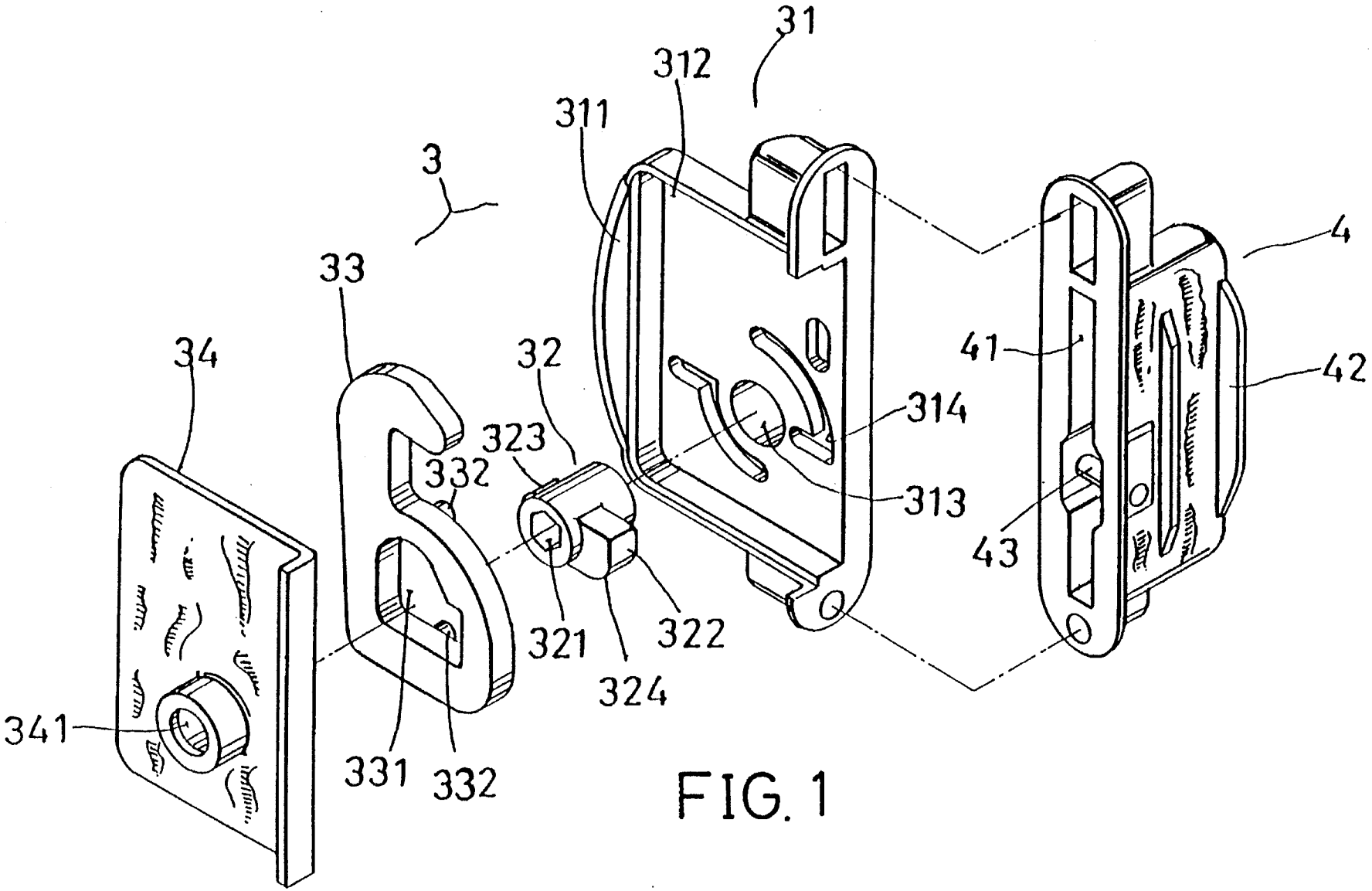
FIG. 1: A three-dimensional dissection drawing of the tightening latching device pertaining to the present invention.

Said latching assembly 3 comprises a latching assembly housing 31, bracing roller 3 2, latch 33 and housing cover 3 4, wherein one side of said assembly housing 31 is equipped with a protruding positioning plate 311, the inner wall of the chamber 312 of said assembly housing 31 possesses a through hole 313 and a pair of corresponding slots 314, the bracing roller 32 is equipped with a driving hole 321, protruding actuation piece 322 and protruding piece 323, said bracing roller 32 can be inserted snugly into the through holes 313 and 341 of said latching housing 31 and housing cover 34 respectively, and be positioned inside the opening 331 of said latch 33, said latch 33 is equipped with two protruding rods 332 to be housed inside said pair of corresponding slots 314, and said housing cover 34 is to be attached to said latching assembly housing 31 with an adhesive, thereby forming said latching assembly 3.

Said spline assembly 4 is a one-piece component fabricated by molding, consisting of a housing slot 41 and positioning plate 42, wherein said spline assembly 4 is equipped with a stopping rod 43 at an appropriate position.

Figure 2:
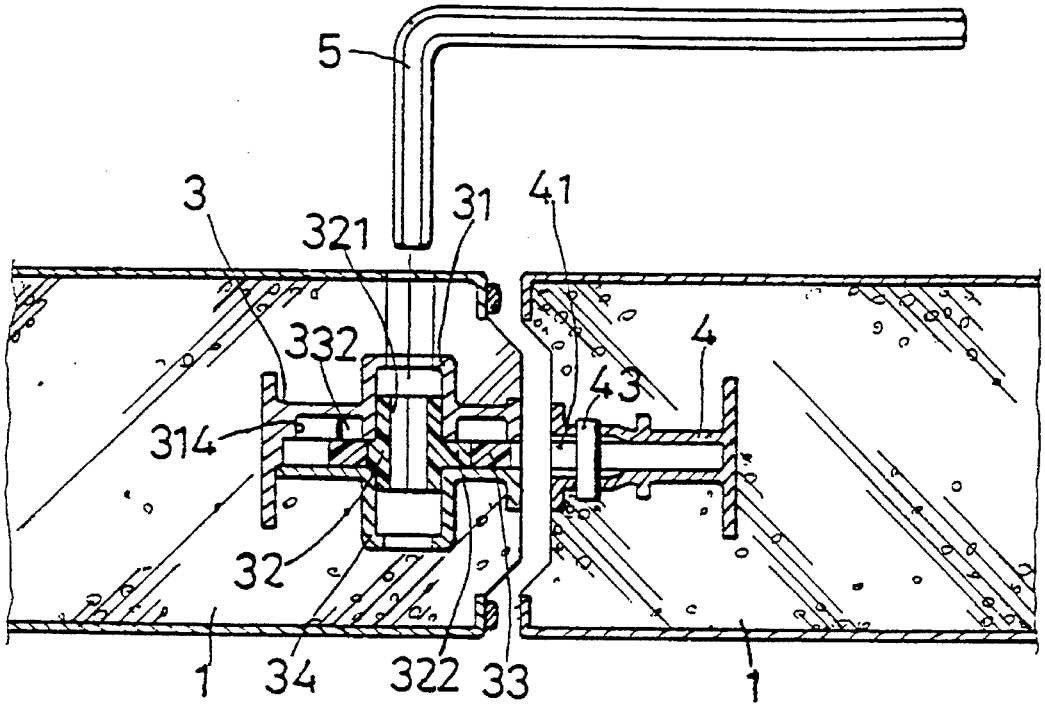
FIG. 2: An upper view of the configuration of the tightening latching device pertaining to the present invention embedded in the scarf panels.
Figure 3:
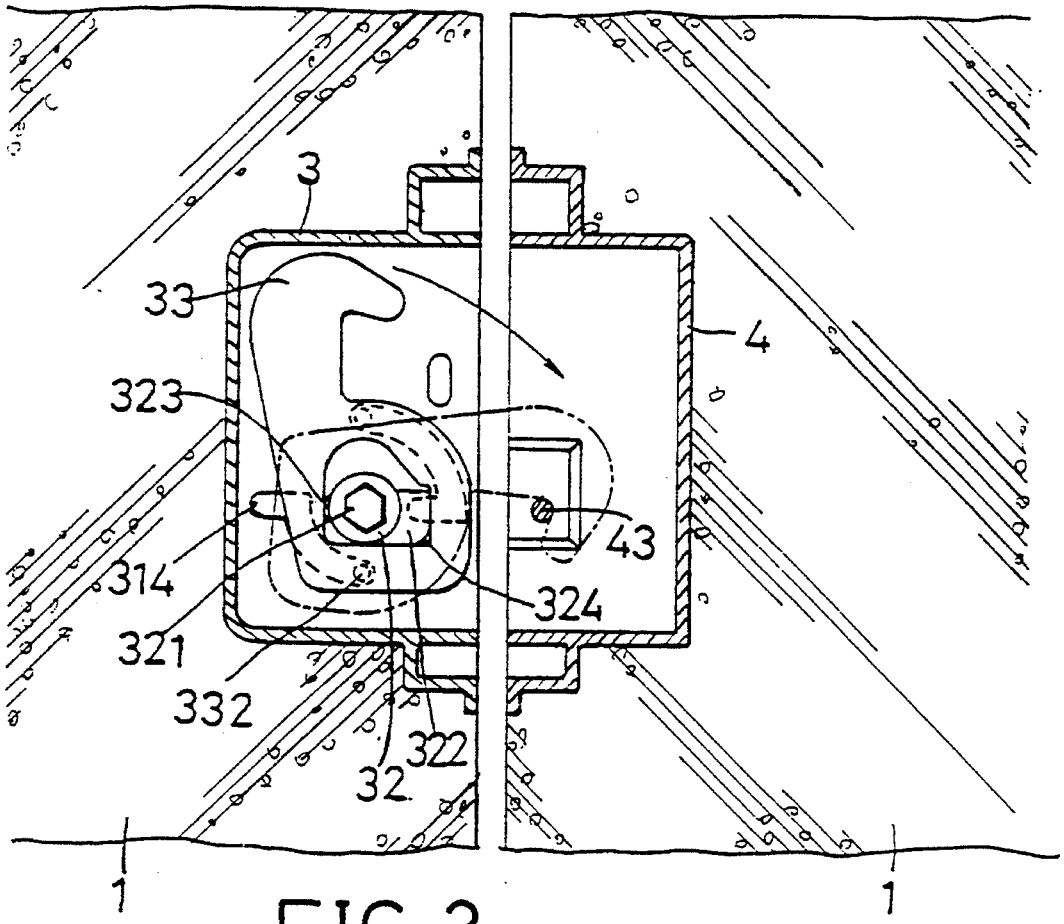
FIG. 3: A side view and action drawing of the tightening latching device pertaining to the present invention.
Figure 4:
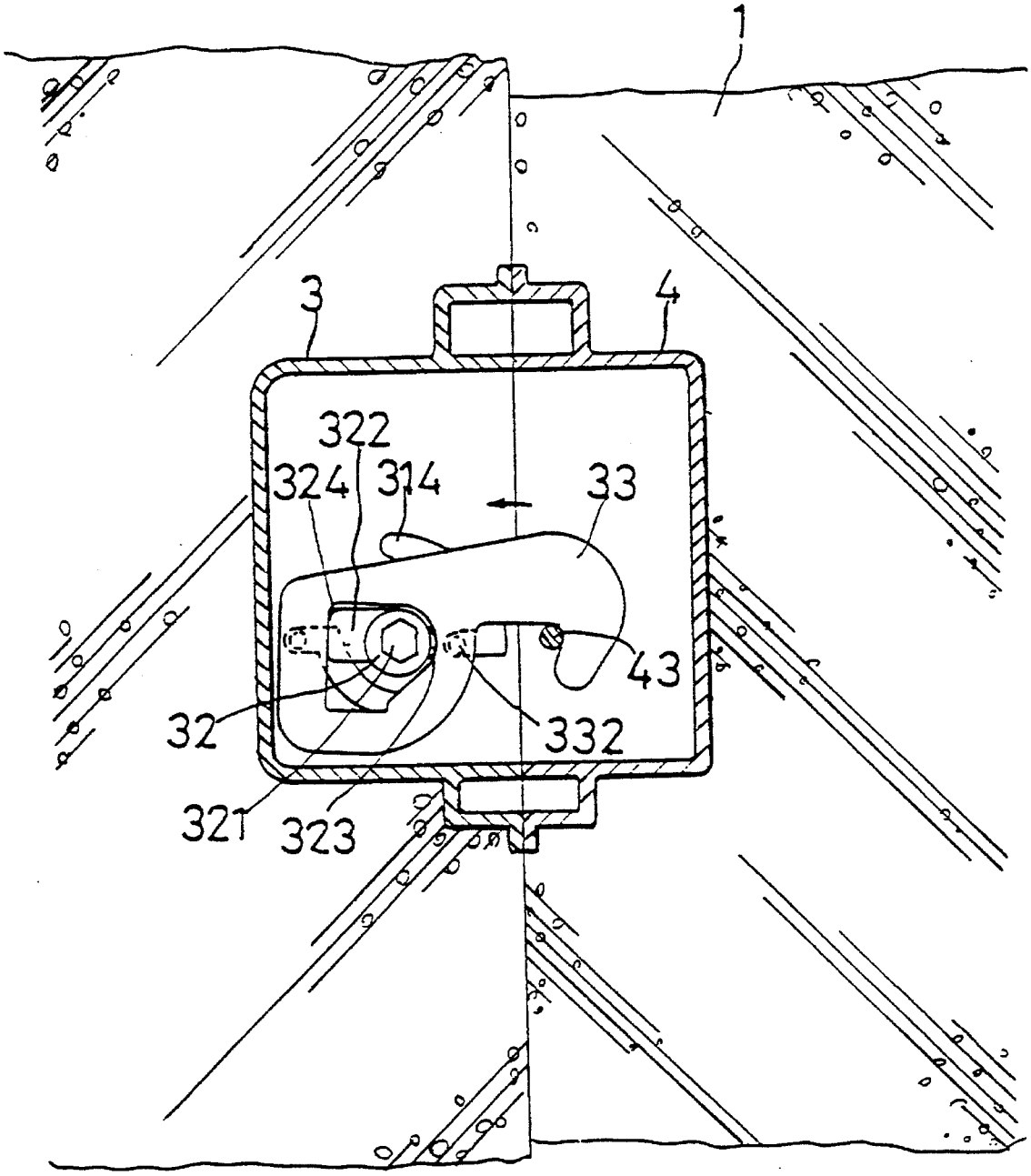
FIG. 4: A drawing showing the configuration of two scarf panels being latched tightly together.
Figure 5:
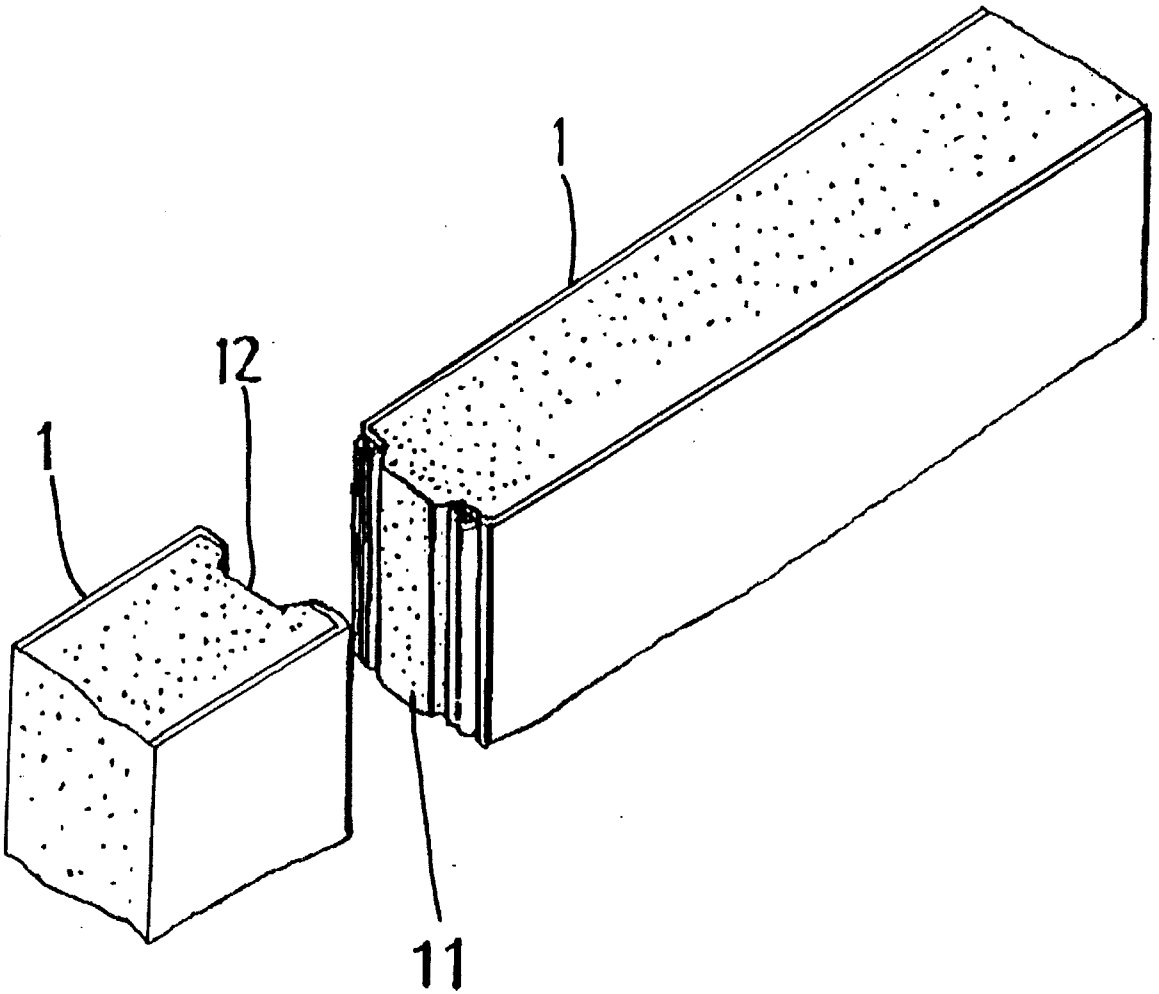
FIG. 5 PRIOR ART
FIG. 5: A drawing showing the configuration of a conventional scarf panel unit.
Figure 6:
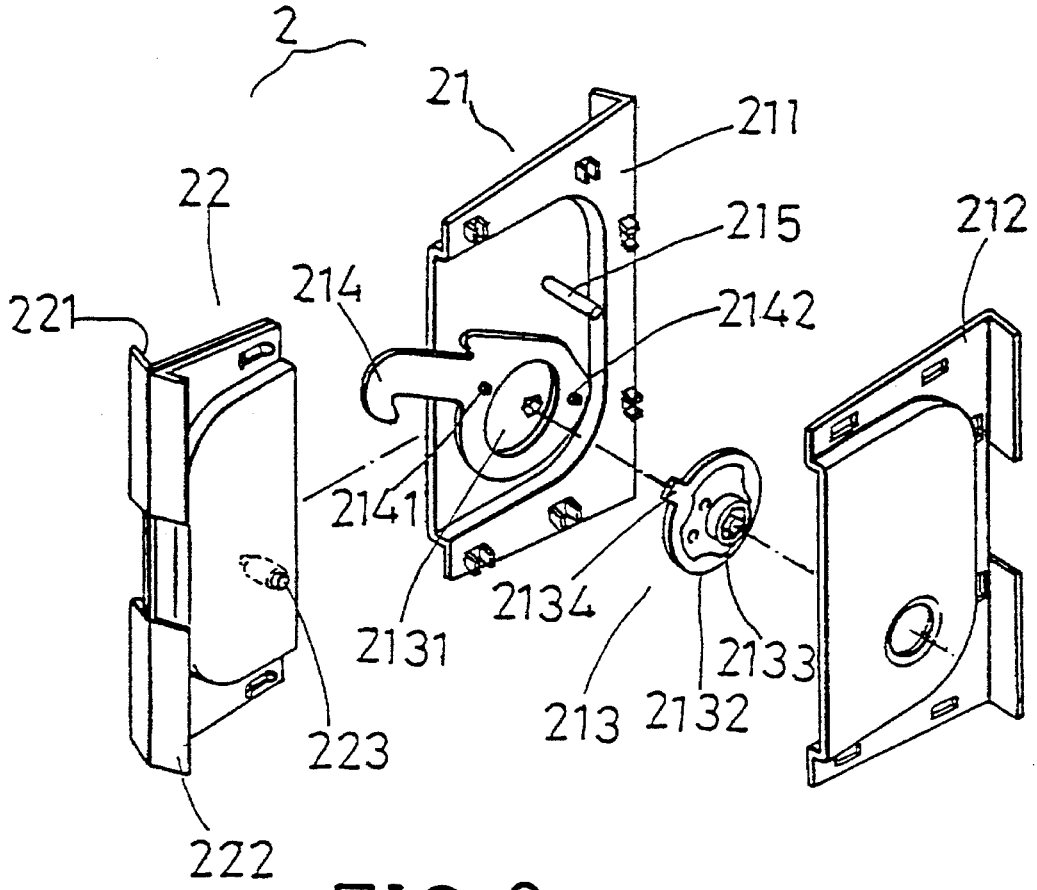
FIG. 6 PRIOR ART
FIG. 6: A three-dimensional dissection drawing of the configuration of a conventional tightening latching device.
Figure 7:
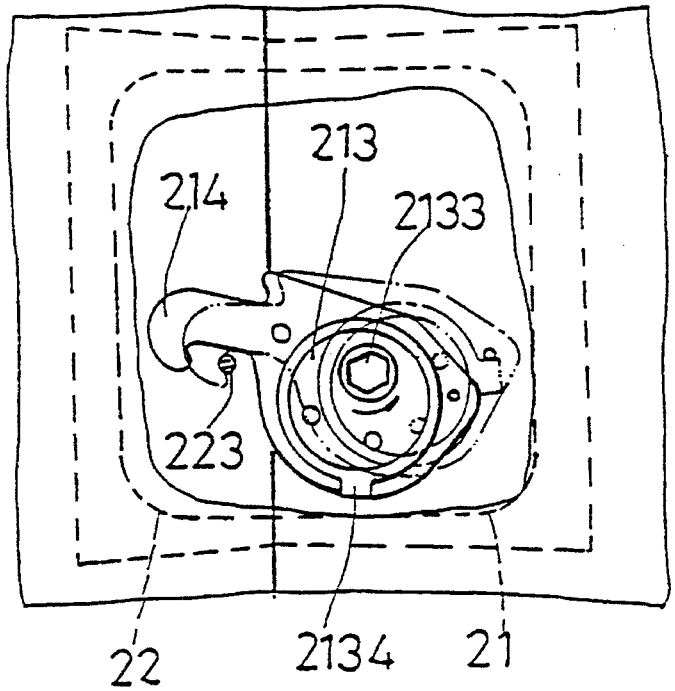
FIG. 7 PRIOR ART
FIG. 7: A drawing showing the action of a conventional tightening latching device.

FIGS. 2 and 3 depict the operation of the aforementioned components. A wrench 5 inserted into said driving hole 321 is employed to latch together said latching assembly 3 and spline assembly 4 embedded inside the scarf panels 1. The turning of said wrench 5 causes said actuation piece 322 to push against the rounded side of said opening 331, thereby allowing said bracing roller 32 to cause said latch 33 to latch onto the corresponding stopping rod 43 of said spline assembly 4. A further turning of said wrench 5 causes said latch 33 to retract due to the guiding action of said corresponding slots 314, with said action preventing said bracing roller 3 from being turned as the guiding corner 324 of said actuation piece 322 and the protruding piece 323 are pressing tightly against said opening 331. Said bracing roller 32 can be caused to turn by applying more pressure on said wrench 5 and to be seated in said opening 331 after exceeding the critical point of said guiding comer 324 as evidenced by a clicking sound, thereby allowing said retracting latch 33 to latch tightly onto said stopping rod 43 and causing the two insulating scarf panels 1 to be held tightly together, as shown in FIG. 4. Said two scarf panels 1 can be disassembled readily by simply turning said bracing roller 32 in the opposite direction. It was found that the tightening latching device pertaining to the present invention remains effective after repetitive uses.

In summary, the present invention possesses the following merits:

1. Unlike conventional tightening latching devices, the tightening latching device pertaining to the present invention is made of a plastic material with a high tensile strength, thereby eliminating the problem of rusting. Furthermore, fewer components are employed, thereby simplifying the manufacturing process, reducing production costs and minimizing wastes.

2. The latching assembly and spline assembly pertaining to the present invention are simple in design, with the objective being to eliminate the problems associated with conventional latches controlled by a protruding roller. In addition, the tightening latching device pertaining to the present invention, which has a simple design as mentioned above, can be assembled easily, thereby reducing labor costs and production costs.

3. As of conventional metal tightening latching devices, it is not uncommon to find that the latch is gripped between the two round plates of said tightening protruding roller as said tightening protruding roller is being turned with a wrench, resulting in a great deal of efforts being needed to accomplish said task. The latch and bracing roller pertaining to the present invention, which are simple and precise, are designed to move smoothly in a corresponding manner. This feature particularly demonstrate the merits of the present invention.

4. As of conventional metal tightening latching devices, it is also not uncommon to find that the tightening protruding roller and latch in poorly-constructed latching assemblies are bound together as though they are a single unit. As a result, the latch cannot be mined, and the scarf panel equipped with said defective latching assembly has to be discarded. The tightening latching device pertaining to the present invention is free from this problem.

5. Deciding on whether or not the latching operation has been completed is subjective, relying on the experience of the operator. As of the tightening latching device pertaining to the present invention, the completion of the latching operation is evidenced by a clicking sound, thereby providing a signal to the operator.

6. The tightening latching device pertaining to the present invention is free from problems, such as the protruding knob of the tightening protruding roller not being able to be governed by the protruding pieces on said latch and the tightening protruding roller being damaged when too great of a force is applied.

7. The tightening latching device pertaining to the present invention is made of a plastic material with a high tensile strength and designed to operate smoothly and precisely, with which two insulation scarf panels can be quickly and securely latched together as well as disassembled readily. The device can be reused many times.

As clearly shown in the aforementioned practical example, the tightening latching device pertaining to the present invention is an effective novel device capable of achieving the stated objective.

I claim:

1. A tightening latching device comprising:

a housing including a hollow chamber formed therein and including an inner wall having a first hole formed therein and having a pair of curved slots oppositely formed therein, said curved slots including a center portion and including a first end and a second end, said first hole being located in said center portion of said curved slots, a cover secured to said housing so as to enclose said hollow chamber, said cover including a second hole aligned with said first hole of said housing, a roller rotatably engaged in said first hole of said housing and said second hole of said cover, said roller including an actuating piece and a protruding piece oppositely extended therefrom and rotated in concert with said roller, said roller including a driving hole formed therein for rotating said roller, a latch including an opening formed therein for engaging with said roller and for engaging with said actuating piece and said protruding piece of said roller, said latch being rotated by said roller when said roller is rotated, said latch including a side portion having two protruding rods extended therefrom for slidably engaging with said curved slots of said housing and movable from said first end to said second end of said curved slots, said protruding rods being forced to engage with said second end of said curved slots by engagement of said actuating piece and said protruding piece of said roller with said opening of said latch, a spline including a housing slot formed therein and including a stopping rod laterally extended in said housing slot, said latch being rotated by said actuating piece and said protruding piece of said roller when said roller is rotated in order to engage with and to catch said stopping rod of said spline, said protruding rods of said latch being caused to move from said first end to said second end of said curved slots so as to engage said latch with said stopping rod of said spline.

* * * * *